US006758519B2

(12) United States Patent
Harvey

(10) Patent No.: US 6,758,519 B2
(45) Date of Patent: Jul. 6, 2004

(54) SEAT HAVING READILY ACCESSIBLE BASKET

(76) Inventor: Brian Harvey, 17490 Meandering Way #106, Dallas, TX (US) 75252

( * ) Notice: Subject to any disclaimer, the term of this patent is extended or adjusted under 35 U.S.C. 154(b) by 0 days.

(21) Appl. No.: 10/026,300

(22) Filed: Dec. 21, 2001

(65) Prior Publication Data

US 2003/0116998 A1 Jun. 26, 2003

(51) Int. Cl.[7] ..... A47C 7/62; A47K 3/022

(52) U.S. Cl. ..... 297/188.08; 297/188.11; 297/188.12; 297/188.2; 297/188.21; 4/611; 4/578.1

(58) Field of Search ..... 297/188.08, 188.11, 297/188.12, 188.2, 188.21, 188.13, 188.191, 188.17; 4/611, 579, 578.1, 559, 444, 605; 248/275, 304, 303; 108/26; 312/334.28, 334.26, 286

(56) References Cited

U.S. PATENT DOCUMENTS 583,752 A * 6/1897 Johnston ..... 312/282
1,856,847 A * 5/1932 Gates ..... 248/231.81
2,532,255 A * 11/1950 Davis ..... 248/215
2,565,719 A * 8/1951 Church ..... 248/215
2,652,887 A * 9/1953 Fitzgerald ..... 297/188.11
2,885,694 A * 5/1959 Ulm ..... 5/308
3,232,686 A * 2/1966 Syler ..... 312/235.5
4,061,395 A 12/1977 Boole ..... 297/192
4,140,355 A * 2/1979 Swain ..... 312/330.1
4,453,279 A 6/1984 Logsdon ..... 4/559
4,489,448 A * 12/1984 Cairo ..... 4/574.1
4,656,678 A * 4/1987 Lipski ..... 4/578.1
4,811,438 A * 3/1989 Simpson ..... 5/308
5,096,249 A * 3/1992 Hines ..... 296/37.15
5,168,583 A 12/1992 Wanke ..... 4/444
5,188,442 A * 2/1993 Harty et al. ..... 297/188.11
5,640,723 A * 6/1997 Stanek ..... 4/578.1
5,641,197 A * 6/1997 Springmann ..... 297/188.11
6,074,000 A * 6/2000 Wagner ..... 297/188.11
6,289,529 B1 * 9/2001 Harvey ..... 4/605

* cited by examiner

*Primary Examiner*—Peter M. Cuomo
*Assistant Examiner*—Sarah C. Burnham
(74) *Attorney, Agent, or Firm*—Michael L. Diaz

(57) ABSTRACT

A seat for use by a person bathing includes a horizontal surface supported by four legs. Each leg is connected to another leg to form a support assembly. Each support assembly is affixed to the underside of the horizontal surface. The seat also includes two guide rails which support a basket mounted on the underside of the horizontal surface. The basket may be slid out from either the front or rear of the horizontal surface. The guide rails are also used to reinforce the seat. In addition, the basket may be affixed to an edge of the horizontal surface to allow access by the user of the seat.

8 Claims, 4 Drawing Sheets

SEAT HAVING READILY ACCESSIBLE BASKET

BACKGROUND OF THE INVENTION

1. Technical Field of the Invention

This invention relates to seats located within bathrooms, and more particularly, to a moveable seat having a readily accessible basket.

2. Description of Related Art

Many elderly and disabled people require assistance in bathing. It is quite common for nurses to bathe their patients by sitting the patient upon a stool within a shower stall. The nurse then bathes the seated patient. However, it can be a very cumbersome process for the nurse to bathe the patient. First of all, the required bathing supplies (e.g., wash towels, brush, soap, shampoo, etc.) are not always within arms reach. Also, many times the nurse must hold the patient upright with one hand while simultaneously bathing the patient with the other hand. If the bathing supplies are not immediately available, the nurse must let go of the patient and quickly retrieve the bathing supplies. This can be dangerous to the patient who may be left unsupported during the retrieval process. Additionally, many times, the nurse must move around the patient to bathe the patient from different sides. A seat is needed which allows the nurse to maintain support to a patient while providing ready access to the bathing supplies.

Although there are no known prior art teachings of a device such as that disclosed herein, prior art references that discuss subject matter that bears some relation to matters discussed herein are U.S. Pat. No. 4,061,395 to Boole (Boole), U.S. Pat. No. 4,453,279 to Logsdon (Logsdon), and U.S. Pat. No. 5,168,583 to Wanke (Wanke).

Boole discloses a portable drawer for use under a four-legged chair. The drawer includes an enclosure having an open top and whose width is selectively adjustable for positioning of the enclosure between the four legs. The enclosure is mounted on the four legs for sliding movement into and out of the space between the four legs. Boole does disclose a drawer slidably attached to the underside of a chair. However, Boole does not disclose a basket which may be slid out from under a horizontal surface either from a forward or aft position. In addition, Boole does not disclose utilizing a slide assembly to reinforce the leg structure. Boole also does not teach or suggest a basket which may be affixed against the edge of the horizontal surface of the chair.

Logsdon discloses a bath rack assembly for use in a bath or shower stall having a bath seat appliance to store and retain toiletries and bathing materials within reach of a person utilizing the bath seat appliance. The bath rack assembly has an attachment bar which removably hooks onto the bath seat appliance and has a floor, back, and at least one retaining bar to retain the toiletries and bathing materials on the bath rack assembly. The floor and back of the rack assembly are also generally porous to prevent retaining of bathing water. A retaining bar is provided for attachment of a razor blade shaving device. A generally horizontal grid apparatus is attached to the retaining bar to provide a storage position for a bar of soap. Although Logsdon discloses a device providing access to shower supplies, Logsdon does not teach or suggest a stool having reinforced railing to supplement the structural integrity of the seat structure. Additionally, Logsdon does not teach or suggest a basket which is slidably attached to the underside of the shower seat.

Wanke discloses a hygiene seat for handicapped persons which includes a rim having two cooperating tubes. The tubes are adjusted in an axial direction. In addition, the underside of the rim include guide rails for receiving a tube or a board. Although Wanke discloses a tub which slides underneath a seat, Wanke does not teach or suggest utilizing the guide rails to reinforce the strength of the seat. In addition, Wanke does not teach or suggest affixing the tube adjacent the horizontal surface of the seat.

It would be a distinct advantage to have a shower seat which allows a nurse to easily retrieve bathing supplies, improves the structural strength of the seat, and allows a basket to be affixed next to an edge of the horizontal surface of the seat. It is an object of the present invention to provide such an apparatus.

SUMMARY OF THE INVENTION

In one aspect, the present invention is a portable seat assembly for use by a person bathing in a shower or bath stall. The seat assembly includes a horizontal surface constructed of a rigid material. The seat assembly also includes a first support having a first leg, a second leg, and a first brace support connecting the first leg to the second leg. The seat assembly also includes a second support having a third leg, a fourth leg and a second brace support connecting the third leg to the fourth leg. The first brace support is affixed to an underside of the horizontal surface with the second brace support diagonally lying across the first brace support on the underside of the horizontal surface. In addition, the seat assembly includes a basket slidably mounted to the underside of the horizontal surface and two guide rails for supporting the two overhanging edges of the basket on the underside of the horizontal surface.

In another aspect, the present invention is a portable seat assembly for use by a person bathing. The seat assembly includes a horizontal surface constructed of a rigid material and four support legs attached to an underside of the horizontal surface. A basket is slidably mounted to the underside of the horizontal surface.

In still another aspect, the present invention is a portable seat assembly for use by a person bathing having, a horizontal surface constructed of a rigid material. The horizontal surface has a plurality of holes. A first support having a first leg, a second leg, and a first brace support connecting the first leg to the second leg is mounted on the underside of the horizontal surface. A second support having a third leg, a fourth leg and a second brace support connecting the third leg to the fourth leg is also mounted diagonally across the first brace support on the underside of the horizontal surface. A basket is slidably mounted to the underside of the horizontal surface. The basket includes a generally horizontal bottom surface and four generally vertical sides affixed to the bottom surface. The four sides and bottom surface form an enclosure for storing shower supplies. The basket also includes two overhanging edges extending outwardly from a top portion of two opposing sides of the basket. Two guide rails are also mounted on the underside of the horizontal surface. Each guide rail forms a lip to support each overhanging edge of the basket. In addition, an adjustable rod is affixed to the horizontal surface and extends from the edge of the horizontal surface to retain the basket against the edge of the horizontal surface.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
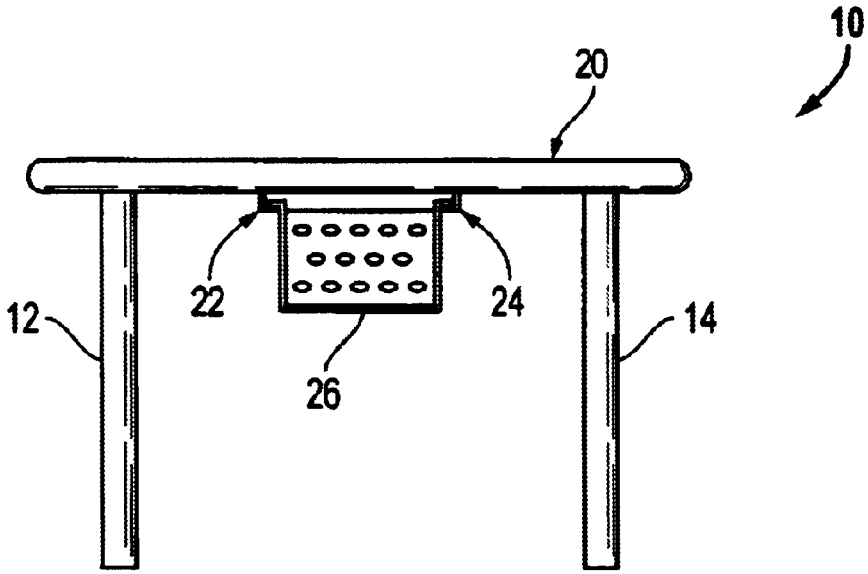
FIG. 1 is a front view of a shower seat in the preferred embodiment of the present invention.

FIG. 1 is a front view of a shower seat 10 in the preferred embodiment of the present invention. The shower seat includes four support legs 12, 14, 16, and 18 supporting a horizontal surface 20. Underneath the horizontal surface is two parallel guide rails 22 and 24 supporting a basket 26.

Figure 2:
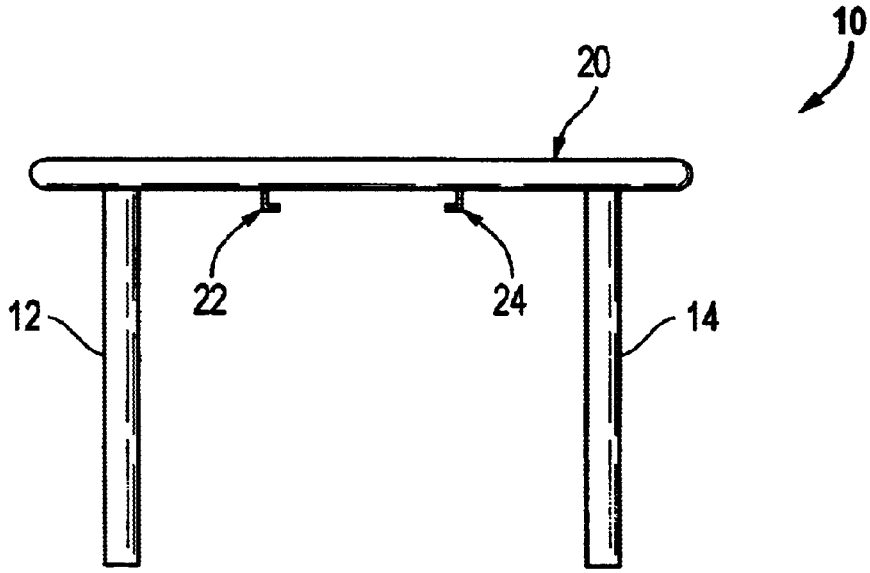
FIG. 2 is a front view of the shower seat with the basket removed from the underside of the horizontal surface.

FIG. 2 is a front view of the shower seat 10 with the basket 26 removed from the underside of the horizontal surface. The basket may be slid either aft or forward to allow a user to access the interior of the basket while still attached to the guide rails 22 and 24 (in a similar fashion to opening a drawer) or completely removing the basket from the guide rails (as illustrated in FIG. 2).

Figure 3:
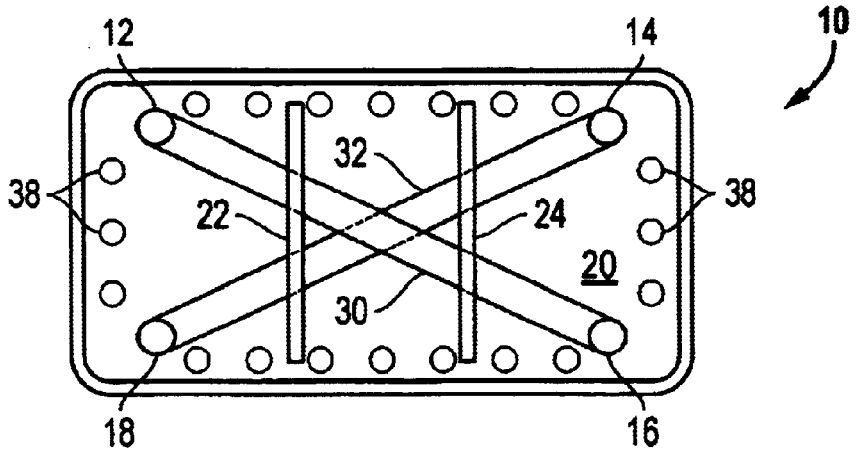
FIG. 3 is a bottom view of the shower seat of FIG. 2 with the basket removed from the shower seat.

FIG. 3 is a bottom view of the shower seat 10 of FIG. 2 with the basket removed from the shower seat. Leg 12 connects to leg 16 by a brace support 30. In addition, leg 14 connects to brace support 32. Each brace support is affixed to the underside of the horizontal surface 20, diagonally crossing one another. The brace supports are positioned between the horizontal surface and the guide rails 22 and 24. The guide rails are affixed to the brace supports. In existing seats having screws holding brace supports to the underside of the horizontal surface, the guide rails may also utilize the same screws to affix the guide rails to the brace supports. However, the guide rails may be affixed to the brace supports in any fashion which connects the guide rails to the brace supports. The guide rails thus provide a dual purpose. First, the guide rails are used to hold the basket 26 underneath the horizontal surface. The second purpose is for the guide rails to provide additional structural strength and stability to the four support legs by acting as supports for each brace support. The horizontal surface 20 also includes a plurality of holes 38 allowing water to pass through the horizontal surface without pooling on the horizontal surface. The horizontal surface may be constructed of any rigid material, such as plastic.

Figure 4:
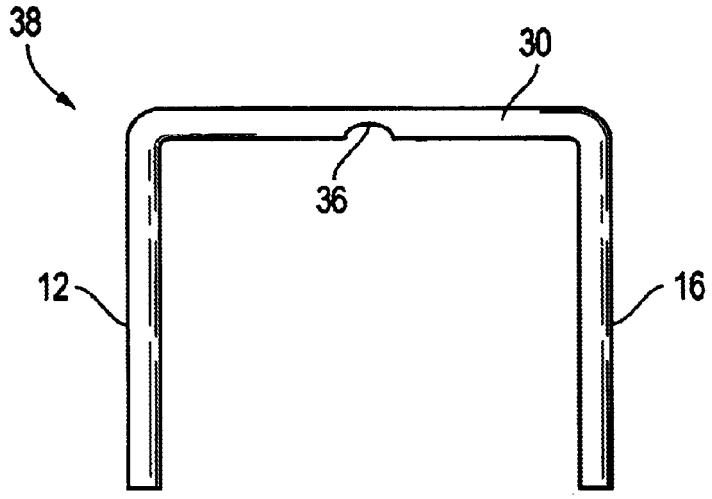
FIG. 4 is a front view of the leg, brace support, and leg removed from the horizontal surface.

FIG. 4 is a front view of the leg 12, brace support 30, and leg 16 forming a support assembly 37 removed from the horizontal surface 20. The legs 12 and 16 and the brace support may be one single piece constructed of any rigid material capable of supporting a person's weight, such as aluminum or steel. In an alternate embodiment of the present invention, the legs 12 and 16 and the brace support 30 may be three separate pieces joined together. Preferably, the brace support may include an indentation 36 allowing the brace support 32 to lie flat against the brace support 30. The leg 14, the brace support 32, and the leg 18 are constructed in a similar manner as illustrated in FIG. 4.

Figure 5:
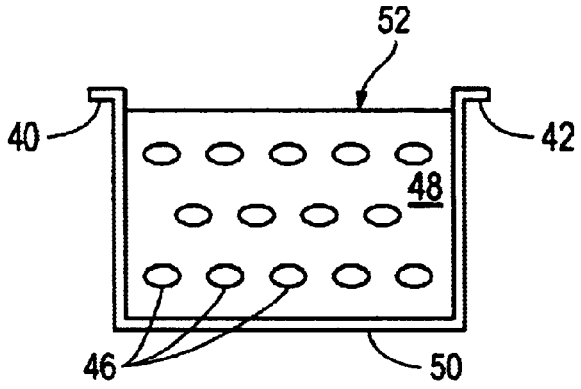
FIG. 5 is a front view of the basket removed from the seat.

FIG. 5 is a front view of the basket 26 removed from the shower seat 10. The basket includes two overhanging edges 40 and 42. The overhanging edges extend outwardly and are sized to fit within the guide rails 22 and 24. Each railing forms a lip to support each overhanging edge of the basket. As discussed above, the guide rails are preferably attached to the underside of the brace supports in such a manner that the guide rails can support the weight of the basket and any shower supplies. For example, the guide rails can be bolted, nailed or glued to the brace supports. The guide rails may be constructed of any material providing a surface capable of supporting a basket. In the preferred embodiment, the material is adapted for use in water, such as a plastic. As illustrated in FIG. 1, the guide rails support the basket by supporting the overhanging edges.

Referring back to FIG. 5, the basket 26 includes a plurality of apertures 46. The basket includes four walls (only wall 48 is shown) and a floor 50. The basket has an open top allowing access to the interior 52. The apertures prevent water from being retained within the interior of the basket.

Figure 6:
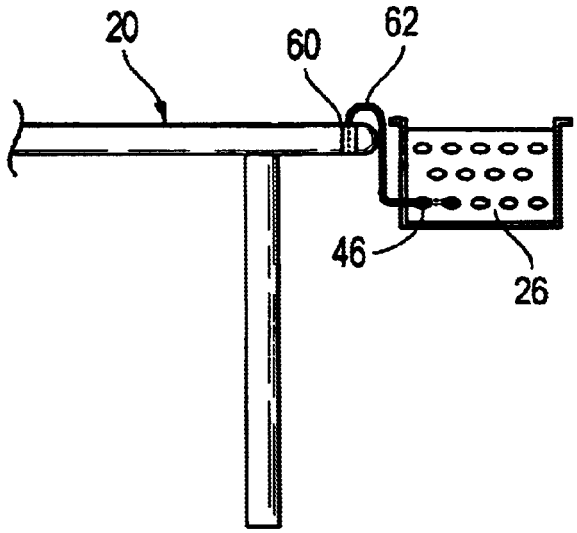
FIG. 6 is a partial side view of a portion of the shower seat having the basket affixed to a front edge of the horizontal surface.

FIG. 6 is a partial side view of a portion of the shower seat 10 having the basket affixed to a front portion 60. The basket may be positioned adjacent to the front portion 60 of the horizontal seat 20 by an adjustable rod 62.

The adjustable rod is shaped in such a fashion as to fit within one of the holes 38 of the horizontal surface 20 and bent to retain the basket against the front portion of the horizontal surface. The adjustable rod may be any material having the strength to hold the basket and any shower supplies against the horizontal surface. The adjustable rod holds the basket in position by threading itself through one of the apertures 46 of the basket.

With reference to FIGS. 1–6, the operation of the shower seat 10 will now be explained. The shower seat does not need to be permanently affixed to the shower or bath stall. In fact, one of the advantages of the shower seat is that it is a moveable seat which allows the easy removal and transport of the seat. A nurse may position the shower seat within a shower stall to allocate enough room for the nurse to be present within the stall. The patient is placed on the top of the horizontal surface 20. Any required shower supplies, such as soap, shampoo, and wash clothes may be located within the interior 50 of the basket 26.

The basket 26 may be located underneath the horizontal surface or affixed to the front or rear edge of the horizontal surface. With the basket located in any of these locations, the contents of the basket may be easily accessed by the nurse with one hand, which allows the nurse to support the seated patient with her other hand. Thus, if the basket is located underneath the horizontal surface and supported by the guide rails 22 and 24, the basket may be slid either forward or aft, depending on the location and desires of the nurse. The basket may be slid and removed from the underside by either sliding the basket forward or aft completely away from the guide rails. If the nurse desires for the basket to be retained in a position allowing even easier access to the nurse, the basket may be retained adjacent the horizontal surface 20 by the adjustable rod 62.

Figure 7:
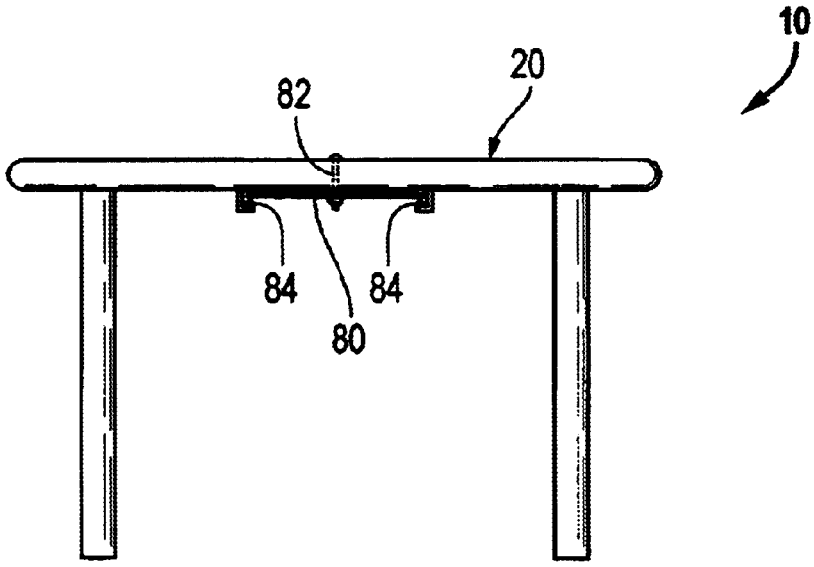
FIG. 7 is a front view of the shower seat 10 without the basket in an alternate embodiment of the present invention.

FIG. 7 is a front view of the shower seat 10 without the basket 26 in an alternate embodiment of the present invention. The shower seat may utilize a pivotable basket cover 80 which is attached to the bottom side of the horizontal surface 20. The cover 80 is preferably attached to the horizontal surface by a bolt 82 or screw. The cover is allowed to pivot about the bolt. However, the cover cannot move horizontally in relation to the horizontal surface.

Figure 8:
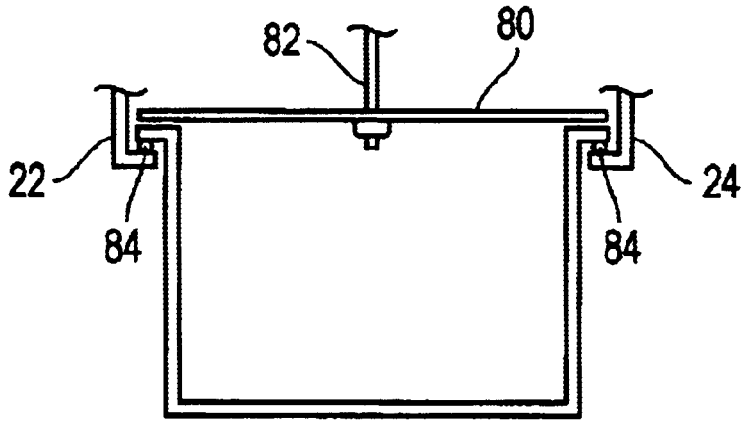
FIG. 8 is an enlarged partial view of the basket cover of FIG. 7 with the basket.

FIG. 8 is an enlarged partial view of the basket cover 80 of FIG. 7 with the basket 26. Four outcroppings 84 are located on each corner of the guide rails 22 and 24. The basket is positioned between the basket cover and the outcroppings 84.

Figure 9:
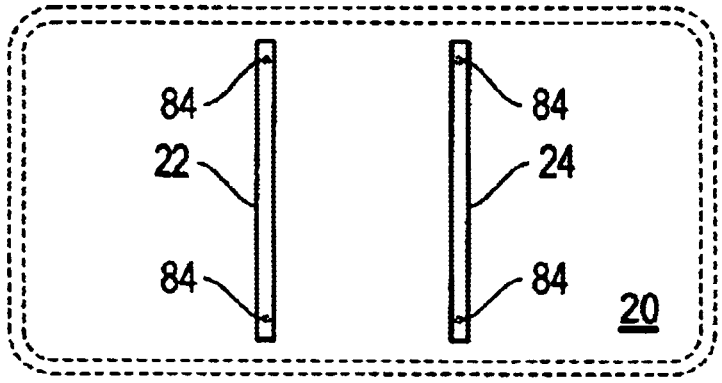
FIG. 9 is a bottom view of the horizontal surface of FIG. 7.

FIG. 9 is a bottom view of the horizontal surface of FIG. 7. As illustrated, the outcroppings are located near the edges of the horizontal surface on the guide rails 22 and 24.

Referring to FIGS. 7–9, the basket cover 80 is used to prevent water from entering the interior of the basket 26 when positioned under the shower seat 10. If the horizontal surface includes holes 38, without the basket cover, water enters into the interior of the basket. The basket cover is pivotably mounted to the bottom side of the horizontal surface. With the basket positioned under the horizontal surface, the cover is horizontally aligned over the basket. The cover cannot pivot with the basket in place because the overhanging edges are pushed upwardly against the cover by the outcroppings. When the basket is pulled out from underneath the horizontal surface, the cover remains positioned under the horizontal surface. As the overhanging edges 40 and 42 are slide out along the guide rails, a space is provided between the outcroppings and the rear portion of the cover. Thus, with the basket partially slide out from under the horizontal surface, the cover is tilted rearwardly, guiding any residual water away from the basket. The basket continues to slide out from under the shower seat and, if desired, may be removed.

The cover allows the contents of the basket to remain substantially dry when positioned under the shower seat. When the basket is slide outwardly, from either the front or the back, the cover tilts in the appropriate direction to guide any excess water located on top of the cover away from the basket. In an alternate embodiment of the present invention, the outcroppings may be located on the overhanging edges. In such an alternate configurations, the outcroppings still perform the same function of tilting the cover in the appropriate direction.

The shower seat 10 provides several advantages over existing shower seats. The shower seat is portable by allowing seat to be placed in any location. The shower seat also allows a nurse, or even the patient, to easily access shower supplies stored within a basket. The basket may be positioned under the horizontal surface or affixed adjacent to an edge of the horizontal surface. In either case, the basket's contents may be easily accessed. In addition, the basket may be slid outwardly, either to the rear or forward portions of the horizontal surface, to allow access or removal of contents within the basket. The unique configuration of the legs and guide rails also provides additional stability and structural strength to the shower seat by allowing the guide rails to act as supports for the legs and horizontal surface.

It is thus believed that the operation and construction of the present invention will be apparent from the foregoing description. While the device described has been characterized as being preferred, it will be readily apparent that various changes and modifications could be made therein without departing from the scope of the invention as defined in the following claims.

What is claimed is:

1. A portable seat assembly for use by a person bathing, the seat assembly comprising:

a sitting horizontal surface constructed of a rigid material and having a plurality of holes;

four support legs attached to an underside of said horizontal surface, said four support legs and horizontal surface being unattached to any flooring or wall;

a basket slidably having plurality of apertures mounted to the underside of said horizontal surface, said basket having:

a generally horizontal bottom surface;

four generally vertical sides affixed to the bottom surface, the four sides and bottom surface forming an enclosure for storing shower supplies; and two overhanging edges extending outwardly from a top portion of two opposing sides of said basket;

means for slidably supporting the two overhanging edges of said basket on the underside of said horizontal surface; and means for affixing said basket to an edge of said horizontal surface:

whereby said basket may be slid horizontally outwardly either fore or aft from said horizontal surface and the person may sit on said horizontal surface.

2. The seat assembly of claim 1, wherein the means for slidably supporting the two overhanging edges of said basket is two guide rails mounted on the underside of said horizontal surface, each guide rail forming a lip to support each overhanging edge of said basket.

3. The seat assembly of claim 1 wherein each guide rail is affixed to the first and second brace supports to provide additional stability to the seat assembly.

4. The seat assembly of claim 1 further comprising means for affixing said basket to an edge of said horizontal surface.

5. The seat assembly of claim 4 wherein the means for affixing said basket to an edge of said horizontal surface is an adjustable rod affixed to the horizontal surface and extending from the edge of the horizontal surface to retain said basket against the edge of said horizontal surface.

6. The seat assembly of claim 1 wherein the means for affixing said basket to an edge of said horizontal surface is an adjustable rod affixed through a hole of said horizontal surface and extending from the edge of said horizontal surface through an aperture of said basket to retain said basket against the edge of said horizontal surface.

7. The seat assembly of claim 1 further comprising a cover pivotably mounted to the underside of the horizontal surface.

8. The seat assembly of claim 7 wherein the means for slidably supporting the two overhanging edges includes a plurality of outcroppings;

whereby said cover is tilted when said basket is slid outwardly from under said horizontal surface.

* * * * *